US011607010B2

(12) United States Patent
Campos, II et al.

(10) Patent No.: US 11,607,010 B2
(45) Date of Patent: Mar. 21, 2023

(54) SOLE STRUCTURE FOR ARTICLE OF FOOTWEAR

(71) Applicant: NIKE, Inc., Beaverton, OR (US)

(72) Inventors: Fidencio Campos, II, Dallas, OR (US); Wesley K. Chan, Portland, OR (US); Zachary M. Elder, Portland, OR (US); Elizabeth Langvin, Sherwood, OR (US); Lee D. Peyton, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 82 days.

(21) Appl. No.: 16/772,079

(22) PCT Filed: Dec. 12, 2018

(86) PCT No.: PCT/US2018/065080
§ 371 (c)(1),
(2) Date: Jun. 11, 2020

(87) PCT Pub. No.: WO2019/118540
PCT Pub. Date: Jun. 20, 2019

(65) Prior Publication Data

US 2020/0359742 A1 Nov. 19, 2020

Related U.S. Application Data

(60) Provisional application No. 62/598,771, filed on Dec. 14, 2017.

(51) Int. Cl.
*A43B 13/20* (2006.01)
*A43B 13/18* (2006.01)

(52) U.S. Cl.
CPC ..... *A43B 13/20* (2013.01); *A43B 13/189* (2013.01)

(58) Field of Classification Search
CPC ..... A43B 13/20; A43B 13/203; A43B 13/206; A43B 13/00; A43B 13/18; A43B 13/181;
(Continued)

(56) References Cited

U.S. PATENT DOCUMENTS 5,406,719 A * 4/1995 Potter ..... A43B 13/203 36/28
5,595,004 A * 1/1997 Lyden ..... A43B 13/20 36/35 B (Continued)

FOREIGN PATENT DOCUMENTS

JP 2015526194 A 9/2015
WO WO-200170064 A2 9/2001

(Continued)

OTHER PUBLICATIONS

Japan Patent Office, First Office Action for application No. 2020-532616 dated Aug. 10, 2021.

(Continued)

*Primary Examiner* — Jameson D Collier
*Assistant Examiner* — Matthew R Marchewka
(74) *Attorney, Agent, or Firm* — Honigman LLP; Matthew H. Szalach; Jonathan P. O'Brien

(57) ABSTRACT

A sole structure for an article of footwear having an upper includes a heel region, a forefoot region, and a mid-foot region disposed between the heel region and the forefoot region. The sole structure also includes a fluid-filled chamber including a first barrier layer cooperating with a second barrier layer to define a segment extending along a medial side of the sole structure within the heel region, a second segment extending along a lateral side of the sole structure within the heel region, a third segment extending from one of the first segment and the second segment and terminating at a distal end intermediate the first segment and the second (Continued)

segment, and a web area disposed between and connecting the first segment and the second segment. The first barrier layer is attached to the second barrier layer within the web area.

19 Claims, 10 Drawing Sheets

(58) Field of Classification Search
CPC ... A43B 13/184; A43B 13/189; A43B 13/186; A43B 13/14; A43B 13/143; A43B 13/146; A43B 21/26; A43B 21/265; A43B 21/28; A43B 13/223; A43B 13/125
USPC ..... 36/28, 29, 31, 103
See application file for complete search history.

(56) References Cited

U.S. PATENT DOCUMENTS 5,598,645 A * 2/1997 Kaiser ..... A43B 13/00 36/28
D391,751 S * 3/1998 Santos ..... D2/961
6,253,466 B1 * 7/2001 Harmon-Weiss .... A43B 13/206 36/35 R
7,331,124 B2 * 2/2008 Meschan ..... A43B 13/186 36/27
D911,002 S * 2/2021 Marvin ..... D2/957
2008/0052965 A1 * 3/2008 Sato ..... A43B 7/143 36/103
2011/0185590 A1 * 8/2011 Nishiwaki ..... A43B 13/181 36/28
2012/0023775 A1 * 2/2012 Reilly ..... A43B 7/142 36/31
2013/0145650 A1 * 6/2013 Seo ..... A43B 13/181 36/28
2013/0167401 A1 * 7/2013 Christensen ..... A43B 13/206 36/29
2014/0013624 A1 * 1/2014 Stockbridge ..... A43B 13/181 36/103
2014/0059883 A1 * 3/2014 Adeagbo ..... A43B 13/04 36/28
2014/0283413 A1 * 9/2014 Christensen ..... A43B 3/0057 36/102
2015/0272271 A1 10/2015 Campos, II et al.
2015/0351492 A1 * 12/2015 Dombrow ..... A43B 13/141 36/102
2016/0192737 A1 * 7/2016 Campos, II ..... A43B 13/223 36/28
2017/0119096 A1 * 5/2017 Greene ..... A43B 13/189
2017/0265566 A1 * 9/2017 Case ..... A43B 13/12
2017/0303633 A1 * 10/2017 Hopkins ..... A43B 13/04
2018/0303201 A1 * 10/2018 Greene ..... A43B 13/186

FOREIGN PATENT DOCUMENTS

WO WO-2017160943 A1 9/2017
WO WO-2017160946 A1 9/2017

OTHER PUBLICATIONS

European Patent Office (ISA), International Search Report and Written Opinion for International Application No. PCT/US2018/065080, dated Mar. 28, 2019.
Korean Intellectual Property Office, Office Action for application No. 10-2020-7020239 dated Sep. 9, 2021.

* cited by examiner

SOLE STRUCTURE FOR ARTICLE OF FOOTWEAR

CROSS-REFERENCE TO RELATED APPLICATIONS

This application is the national phase of PCT International Application No. PCT/US2018/065080, filed Dec. 12, 2018, which claims priority to U.S. Provisional Ser. No. 62/598,8771, filed Dec. 14, 2017, the contents of which are hereby incorporated by reference in their entireties.

FIELD

The present disclosure relates generally to sole structures for articles of footwear and more particularly to sole structures incorporating a fluid-filled bladder having a plurality of segments.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing fluid-filled bladders typically include a bladder formed from two barrier layers of polymer material that are sealed or bonded together. The fluid-filled bladders are pressurized with a fluid such as air, and may incorporate tensile members within the bladder to retain the shape of the bladder when compressed resiliently under applied loads, such as during athletic movements. Generally, bladders are designed with an emphasis on balancing support for the foot and cushioning characteristics that relate to responsiveness as the bladder resiliently compresses under an applied load

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
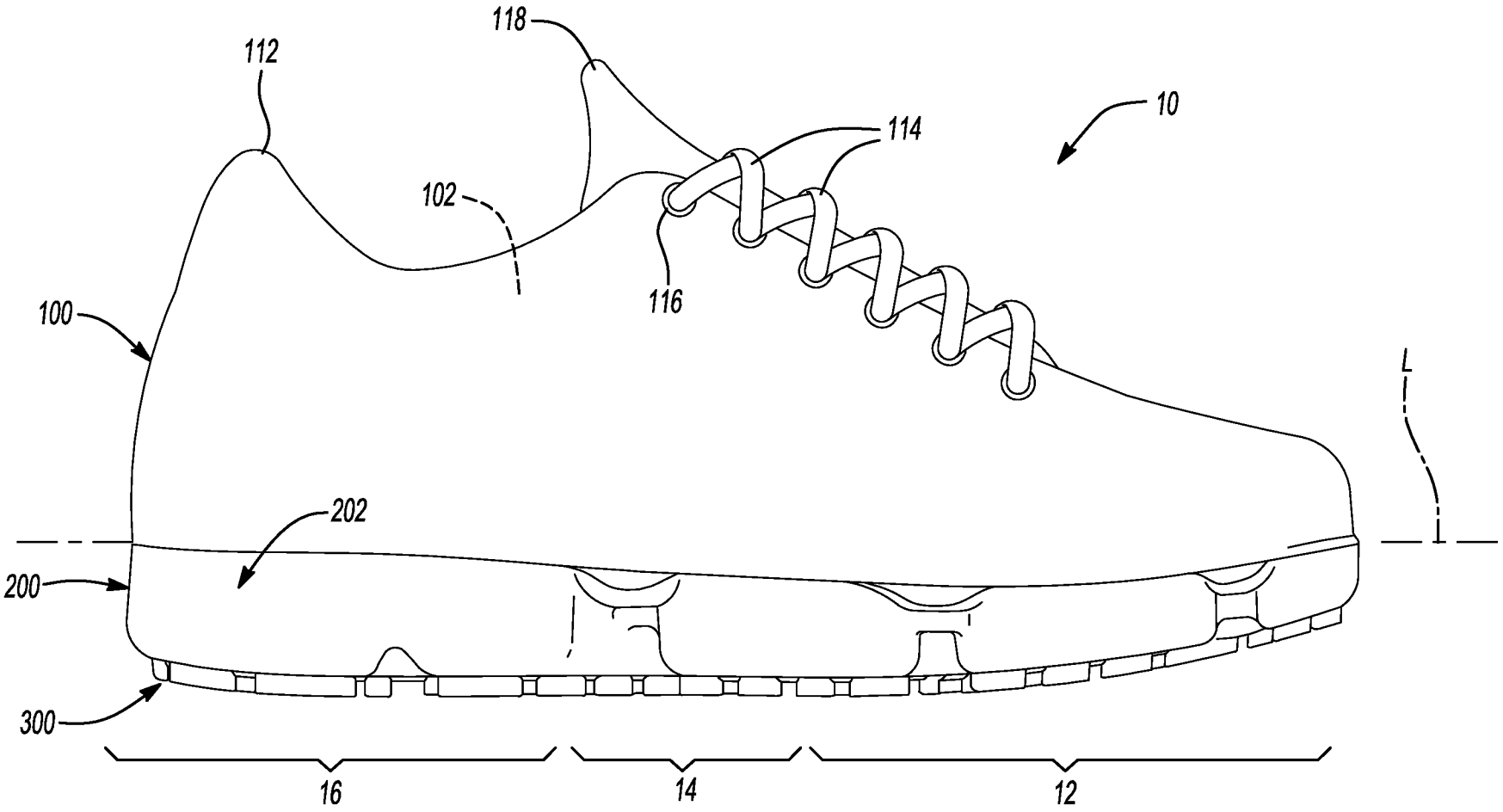
FIG. 1 is a side perspective view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to"

another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a sole structure for an article of footwear having an upper. The sole structure includes a heel region, a forefoot region, and a mid-foot region disposed between the heel region and the forefoot region. The sole structure also includes a fluid-filled chamber including a first barrier layer cooperating with a second barrier layer to define a first segment extending along a medial side of the sole structure from the mid-foot region though the heel region, a second segment extending along a lateral side of the sole structure within the heel region, a third segment extending from one of the first segment and the second segment and terminating at a distal end intermediate the first segment and the second segment, and a web area disposed between and connecting the first segment, the second segment, and the third segment. The first barrier layer is attached to the second barrier layer within the web area.

Implementations of the disclosure may include one or more of the following optional features. In some implementations, the third segment tapers continuously in a direction towards the upper from the one of the first segment and the second segment to the distal end of the fifth segment.

In some examples, the chamber includes a fourth segment extending from the first segment in the mid-foot region to the second segment within the heel region. Optionally, the chamber may also include a fifth segment extending around the heel region and fluidly coupled to the first segment and the second segment. Here, the first segment, the second segment, the fourth segment, and the fifth segment include a contact pad defining a ground-engaging surface of the sole structure. In this example, the web area is recessed from the ground-engaging surface.

In some configurations, the chamber includes a fourth segment extending from the other of the first segment and the second segment and terminating at a distal end between the first segment and the second segment. The fourth segment may taper continuously in a direction towards the upper from the first chamber to the distal end of the fourth segment. The fourth segment may extend substantially parallel to the third segment, and the fourth segment and the fifth segment may extend substantially perpendicular to a longitudinal axis of the sole structure.

Another aspect of the disclosure provides a sole structure for an article of footwear having an upper. The sole structure includes a heel region, a forefoot region, and a mid-foot region disposed between the heel region and the forefoot region. The sole structure also includes a fluid-filled chamber including a first barrier layer cooperating with a second barrier layer to define a first segment extending along one of a medial side of the sole structure and a lateral side of the sole structure within the forefoot region, a second segment extending from a first end of the first segment towards the other of the medial side and the lateral side, and a third segment extending from a second end of the first segment towards the other of the medial side and the lateral side and being divergent from the second segment.

Implementations of the disclosure may include one or more of the following optional features. In some configurations, the chamber includes a fourth segment extending along the other of the medial side and the lateral side, a fifth segment extending from a first end of the fourth segment towards the one of the medial side and the lateral side, and a sixth segment extending from a second end of the fourth segment towards the one of the medial side and the lateral side. The fifth segment may be disposed between the second segment and the third segment. Here, the chamber may include a seventh segment extending along the one of the medial side and the lateral side, an eighth segment extending from a first end of the seventh segment towards the other of the medial side and the lateral side, and a ninth segment extending from a second end of the seventh segment towards the other of the medial side and the lateral side. The third segment and the eighth segment nay be disposed between the fifth segment and the sixth segment. The sixth segment may be disposed between the eighth segment and the ninth segment.

In some examples, the chamber includes a tenth segment extending around the forefoot region from a first end on the one of the medial side and the lateral side to a second end on the other of the medial side and the lateral side. The chamber may also include an eleventh segment extending from the second end of the tenth segment towards the one of the medial side and the lateral side. The fifth segment and the eleventh segment may be disposed between the second segment and the third segment. The second segment, the sixth segment, the seventh segment, and the eleventh segment may be substantially parallel. The third segment may be substantially parallel to the fifth segment. The second, third, fifth, sixth, eighth, ninth, and eleventh segments each may terminate at a distal end between the medial side and the lateral side.

Figure 2:
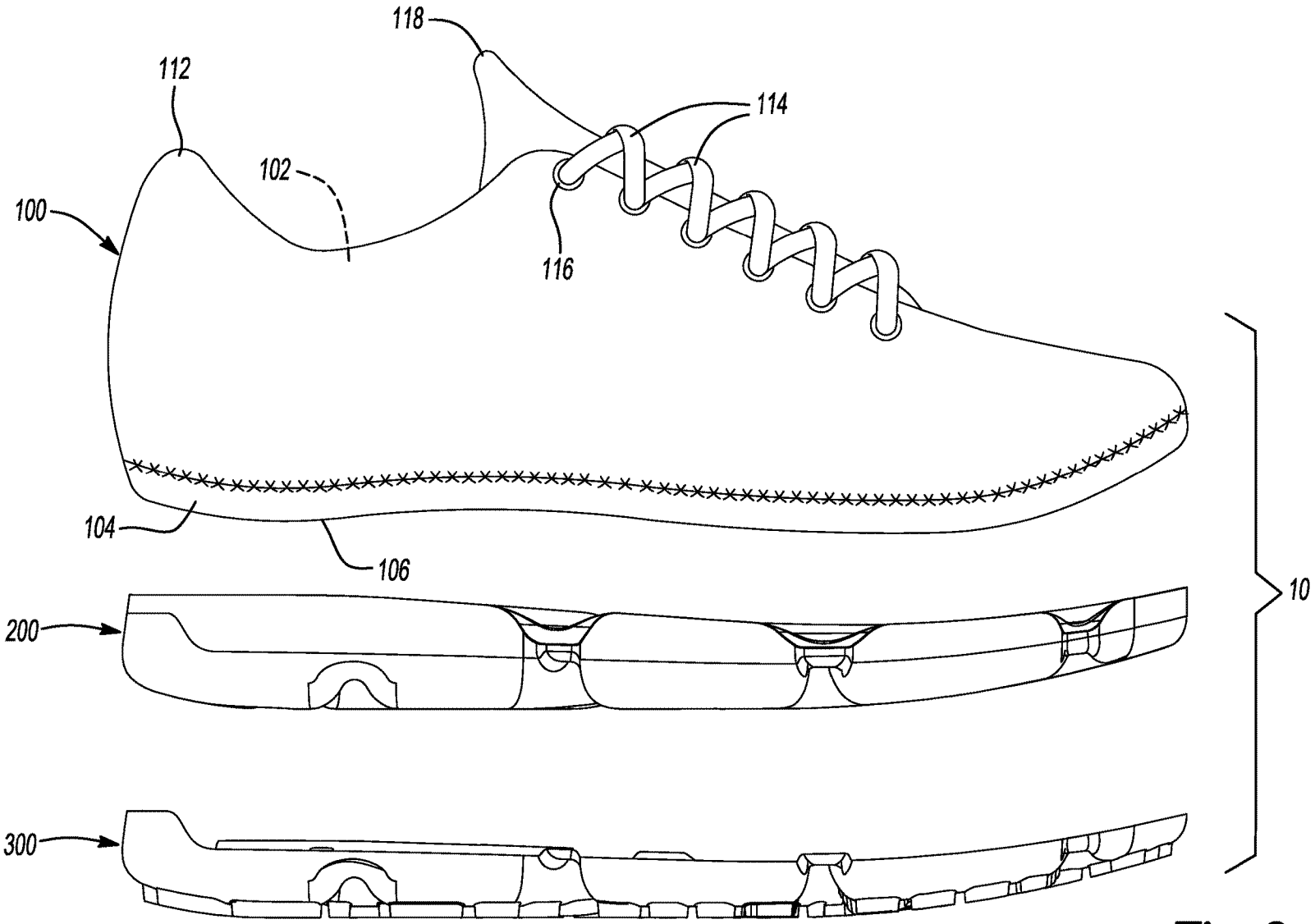
FIG. 2 is an exploded view of the article of footwear of FIG. 1 showing an article of footwear having an upper, a midsole, and an outsole arranged in a layered configuration.

Referring to FIGS. 1 and 2, an article of footwear 10 includes an upper 100, a midsole 200 attached to the upper 100, and an outsole 300 extending between the midsole 200 and a ground surface. The article of footwear 10 may be divided into one or more regions. The regions may include a forefoot region 12, a mid-foot region 14, and a heel region 16. The forefoot region 12 may correspond with toes and joints connecting metatarsal bones with phalanx bones of a foot. The mid-foot region 14 may correspond with an arch area of the foot, and the heel region 16 may correspond with rear portions of the foot, including a calcaneus bone. The footwear 10 may include lateral and medial sides 18, 20, respectively, corresponding with opposite sides of the footwear 10 and extending through the regions 12, 14, 16.

The upper 100 includes interior surfaces that define an interior void 102 configured to receive and secure a foot for support on the midsole 200. The upper 100 may be formed from one or more materials that are stitched or adhesively bonded together to form the interior void 102. Suitable materials of the upper may include, but are not limited to, mesh, textiles, foam, leather, and synthetic leather. The materials may be selected and located to impart properties of durability, air-permeability, wear-resistance, flexibility, and comfort.

Figure 4:
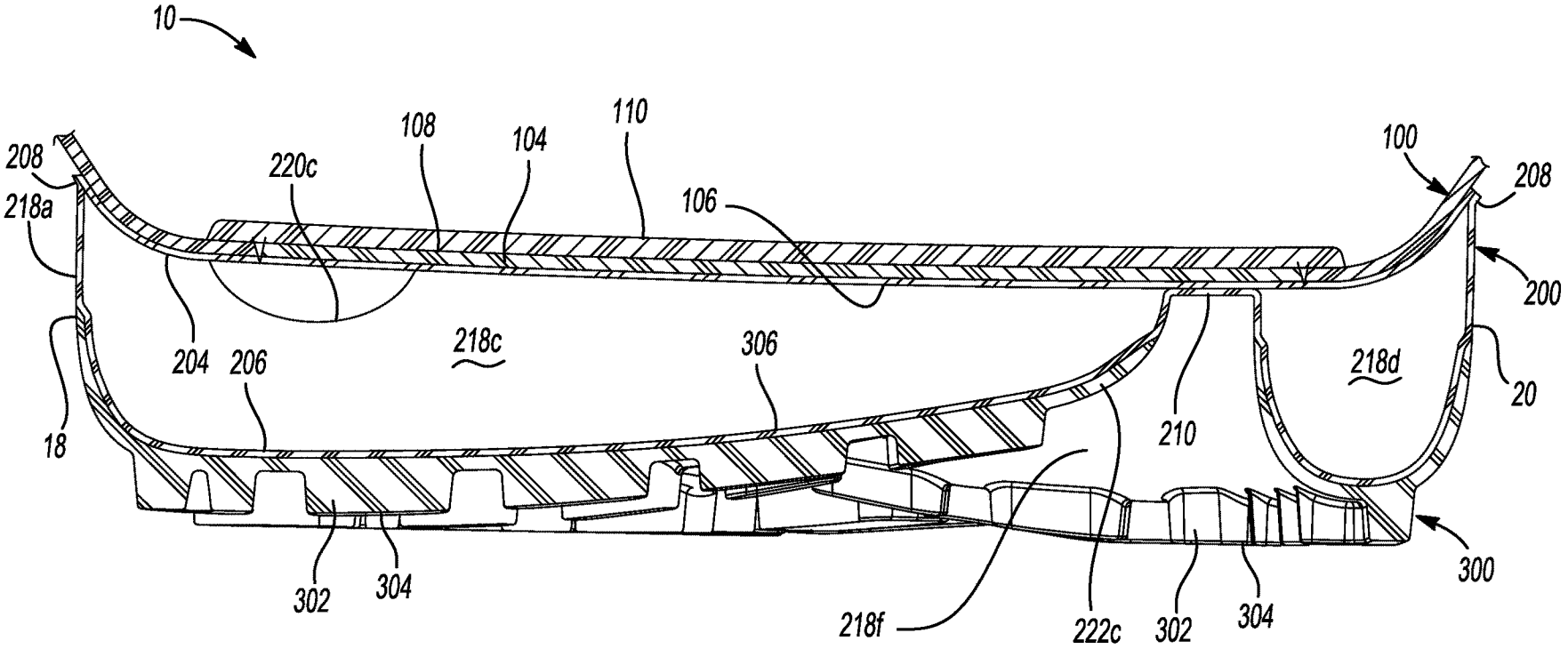
FIG. 4 is a cross-sectional view taken along line 4-4 of FIG. 3 showing segments disposed within a forefoot region of the sole structure and separated from one another by a web area.

In some examples, the upper 100 includes a strobel 104 having a bottom surface 106 opposing the midsole 200 and an opposing top surface defining a footbed 108 of the interior void 102. Stitching or adhesives may secure the strobel 104 to the upper 100. As shown in FIG. 4, the footbed 108 may be contoured to conform to a profile of the bottom surface (e.g., plantar) of the foot. Optionally, the upper 100 may also incorporate additional layers such as an insole 110 or sockliner that may be disposed upon the strobel 104 and reside within the interior void 102 of the upper 100 to receive a plantar surface of the foot to enhance the comfort of the article of footwear 10. An ankle opening 112 in the heel region 16 may provide access to the interior void 102. For example, the ankle opening 112 may receive a foot to secure the foot within the void 102 and facilitate entry and removal of the foot from and to the interior void 102.

In some examples, one or more fasteners 114 extend along the upper 100 to adjust a fit of the interior void 102 around the foot and to accommodate entry and removal of the foot therefrom. The upper 100 may include apertures 116 such as eyelets and/or other engagement features such as fabric or mesh loops that receive the fasteners 114. The fasteners 114 may include laces, straps, cords, hook-and-loop, or any other suitable type of fastener. The upper 100 may include a tongue portion 118 that extends between the interior void 102 and the fasteners 114.

As shown FIGS. 4-7, the midsole 200 includes a bladder 202 defined by an upper barrier layer 204 (hereinafter 'upper layer 204') and a lower barrier layer 206 (hereinafter 'lower layer 206'). The upper layer 204 and the lower layer 206 define barrier layers for the bladder 202 by joining together and bonding at a plurality of discrete locations during a molding or thermoforming process to form a flange 208 extending around the periphery of the midsole 200 and a web area 210 extending between the lateral and medial sides 18 and 20 of the midsole 200. The flange 208 and the web area 210 are disposed proximate to the upper 100 and, thus, are recessed relative to a ground-engaging surface 304 of the outsole 300.

The upper layer 204 of the bladder 202 opposes and attaches (e.g., joins and bonds) to the bottom surface 106 of the strobel 104 of the upper 100. Additionally, the upper layer 204 of the bladder 202 may be contoured to conform to a profile of the bottom surface of the foot to provide cushioning and support for the foot. The upper layer 204 may be formed from one or more polymer materials during a molding process or a thermoforming process and may include an outer peripheral edge that extends upward upon an outer periphery of the upper 100. The lower layer 206 of the bladder 202 is disposed on an opposite side of the bladder 202 than the upper layer 204. The lower layer 206 may include an outer peripheral edge that extends upward toward the upper 100 and bonds with the outer peripheral edge of the upper layer 204 to form the flange 208. As with the upper layer 204, the lower layer 206 may be formed from the same or different polymer material as the upper layer 204.

In some implementations, the upper and lower layers 204, 206 are formed by respective mold portions each defining various surfaces for forming depressions and pinched surfaces corresponding to locations where the flange 208 and/or the web area 210 are formed when the lower layer 206 and the upper layer 204 join and bond together. In some implementations, adhesive bonding joins the upper layer 204 and the lower layer 206 to form the flange 208 and the web area 210. In other implementations, the upper layer 204 and the lower layer 206 are joined to form the flange 208 and the web area 210 by thermal bonding. In some examples, one or both of the upper and lower layers 204, 206 are heated to a temperature that facilitates shaping and melding. In some examples, the layers 204, 206 are heated prior to being located between their respective molds. In other examples, the mold may be heated to raise the temperature of the layers 204, 206. In some implementations, a molding process used to form the bladder 202 incorporates vacuum ports within mold portions to remove air such that the upper and lower layers 204, 206 are drawn into contact with respective mold portions. In other implementations, fluids such as air may be injected into areas between the upper and lower layers 204, 206 such that pressure differentials cause the layers 204, 206 to engage with surfaces of their respective mold portions.

In some implementations, the midsole 200 may include a polymer foam layer (not shown) disposed between the upper layer 204 of the bladder 202 and the upper 100. Thus, the optional foam layer of the midsole 200 is operative as an intermediate layer to indirectly attach the upper layer 204 of the bladder 202 to the upper 100 by joining the upper layer 204 of the bladder 202 to the upper 100 and/or to the bottom surface 106 of the strobel 104. In so doing, the optional foam layer joins the lower layer 206 to the outsole 300, thereby securing the midsole 200 and the outsole 300 to the upper 100. Moreover, the foam layer of the footwear 10 may also reduce the extent to which the upper layer 204 extends onto the peripheral surfaces of the upper 100 and, therefore, increases durability of the footwear 10 by reducing the possibility of the upper layer 204 detaching from the upper 100 over extended use of the footwear 10.

Figure 3:
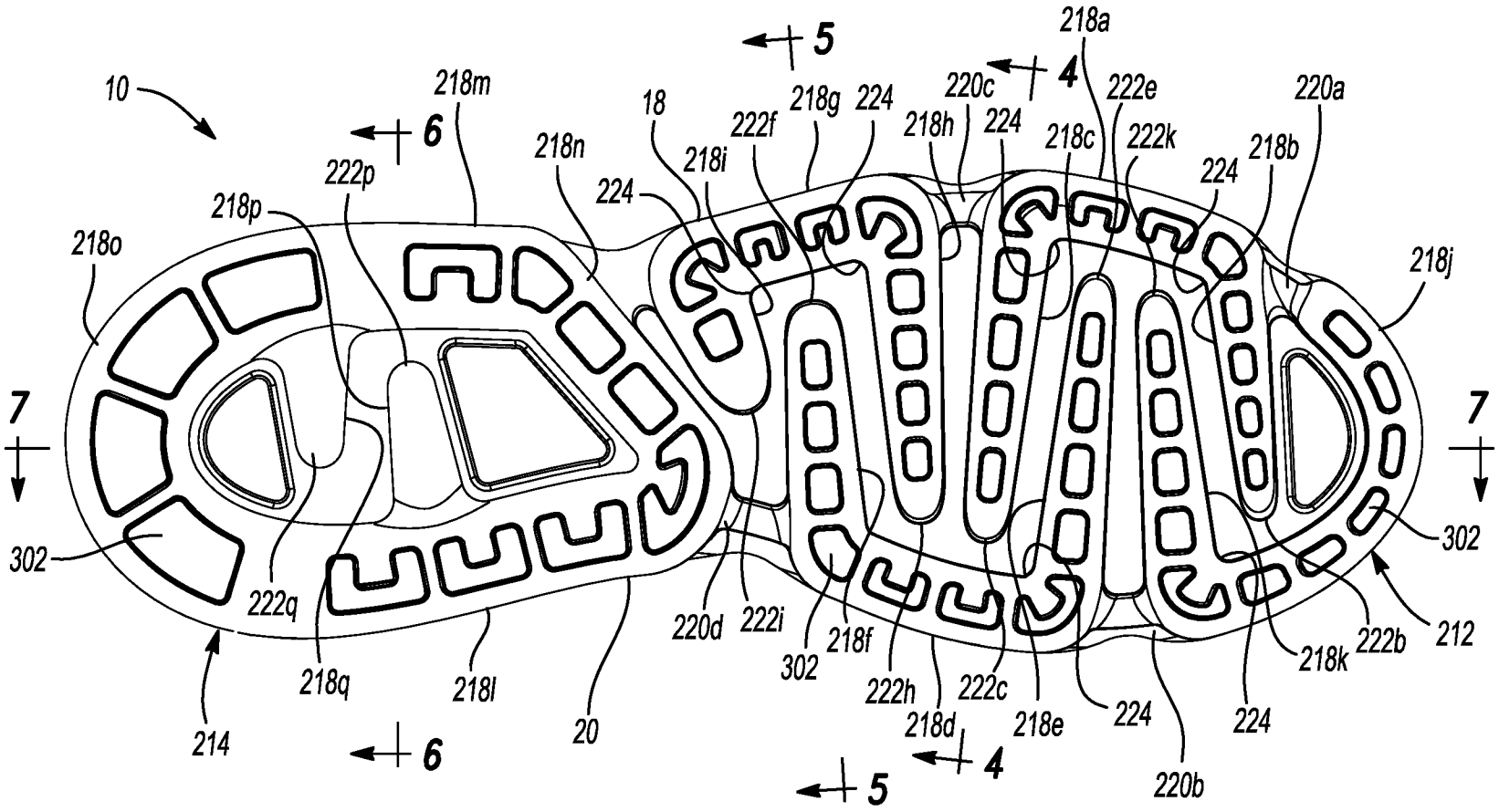
FIG. 3 is a bottom perspective view of the article of footwear of FIG. 1 showing a geometry and configuration of a plurality of segments associated with a bladder of a sole structure.

Referring to FIG. 3, the bladder 202 includes one or more chambers 212, 214. In the illustrated example, a first chamber 212 extends from the mid-foot region 14 to a toe portion of the forefoot region 12 and a second chamber 214 extends through the heel region 16. The second chamber 214 is fluidly coupled to the first chamber 212 by a conduit **220*d***, as described in greater detail below.

The chambers 212, 214 are each defined by a plurality of segments **218*a*-218*q*, which are fluidly coupled to each other by one or more conduits 220*a*-220*d*. In some implementations, the lower layer 206 defines a geometry (e.g., thicknesses, width, and lengths) of the plurality of segments 218*a*-218*q* and the conduits 220*a*-220*d*. The lower layer 206 and the upper layer 204 may join and bond together in a plurality of discrete areas between the lateral side 18 and the medial side 20 of the bladder 202 to form portions of the web area 210 that bound and separate each segment 218*a*-218*q* and conduit 220*a*-220*d*. Thus, each segment 218*a*-218*q* and conduit 220*a*-220*d* is associated with an area of the bladder 202 where the upper and lower layers 204, 206** are not joined together and, thus, are separated from one another to form respective voids.

The flange 208 and web area 210 may cooperate to bound and extend around each of the segments **218*a*-218*q* to contain the fluid (e.g., air) within the segments 218*a*-218*q*. In some examples, regions of the web area 210 are bounded entirely by segments 218*a*-218*q* and/or conduits 220*a*-220*d* while other regions of the web area 210 are bounded by a combination of segments 218*a*-218*q* and/or conduits 220*a*-220*d* along one of the lateral side 18 and the medial side 20, and the flange 208 along the other of the lateral side 18 or the medial side 20. In some configurations, regions of the web area 210 define flexion zones to facilitate flexing of the footwear 10 as the midsole 200 rolls along the ground surface. As shown in FIG. 3, no portion of the web area 210 extends continuously between the lateral side 18 and the medial side 20**.

Figure 5:
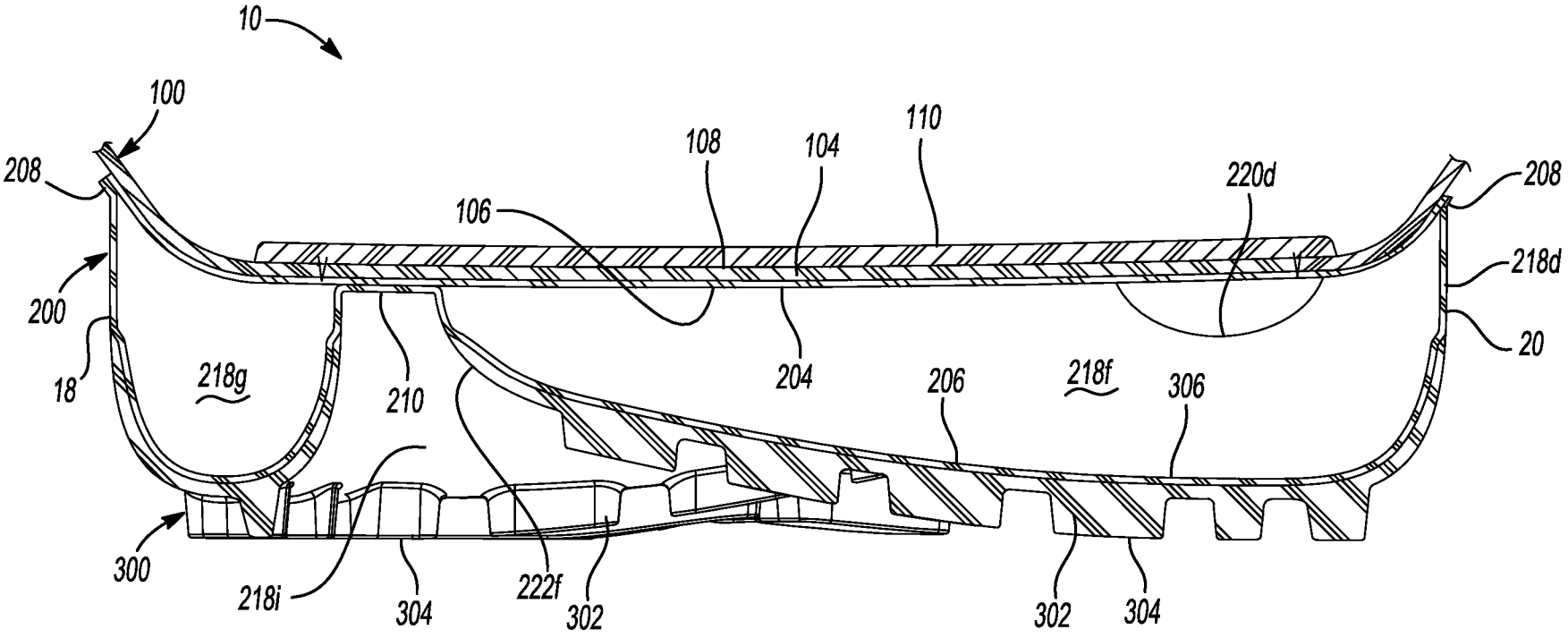
FIG. 5 is a cross-sectional view taken along line 5-5 of FIG. 3 showing segments disposed within a forefoot region of the sole structure and separated from one another by a web area.
Figure 6:
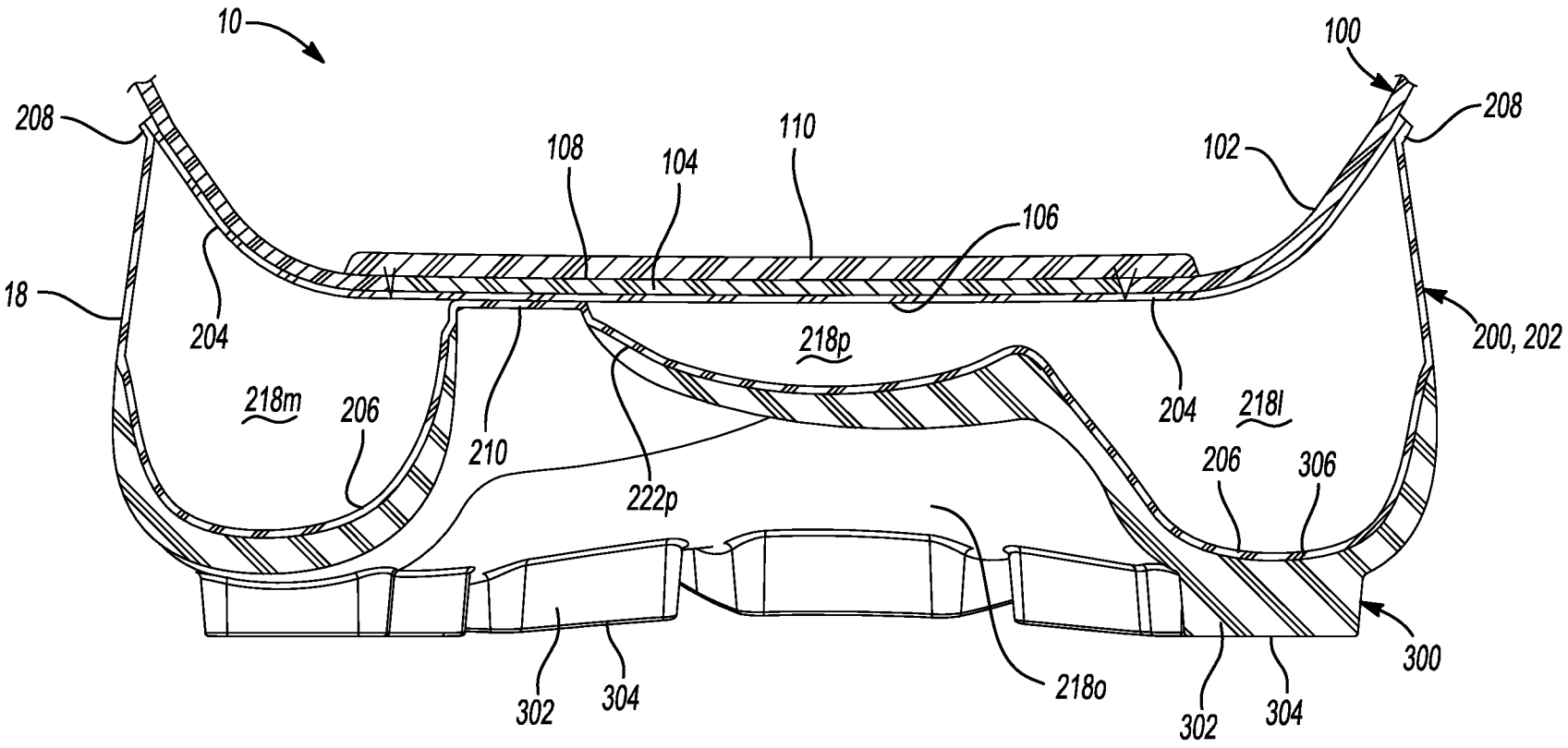
FIG. 6 is a cross-sectional view taken along line 6-6 of FIG. 3 showing segments disposed within a forefoot region of the sole structure and separated from one another by a web area.
Figure 7:
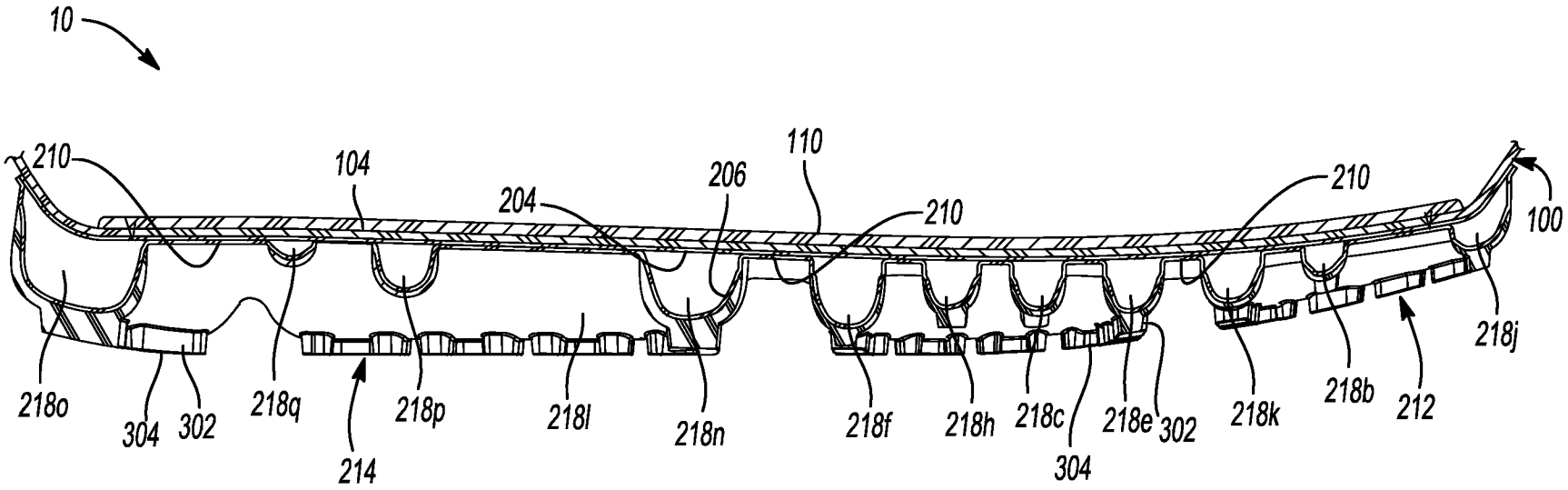
FIG. 7 is a cross-sectional view taken along line 7-7 of FIG. 3 showing an overmolded outsole attached to segments along a length of the sole structure.

As shown in FIGS. 4-7, each segment 218*a*-218*q* and conduit 220*a*-220*d* may define a substantially tubular cross-sectional shape and a thickness that extends substantially perpendicular to the longitudinal axis L of the midsole 200 between the upper layer 204 and the lower layer 206. As such, the thickness of each segment 218*a*-218*q* is defined by a distance the lower layer 206 protrudes away from the upper layer 204 in a direction away from the upper 100. At least two of the segments 218*a*-218*q* may define different thicknesses. For example, one or more segments 218*l*-218*o* disposed in the heel region 16 may be associated with greater thicknesses than thicknesses associated one or more segments 218*a*-218*k* disposed in the forefoot region 12 or the mid-foot region 14. As shown in FIG. 7, a thickness of the midsole 200 gradually decreases from the heel region 16 to the forefoot region 12 to provide a greater degree of cushioning for absorbing ground-reaction forces of greater magnitude that initially occur in the heel region 16 and lessen as the forefoot region 12 of the midsole 200 rolls for engagement with the ground surface.

Each of the segments 218*a*-218*q* and the conduits 220*a*-220*d* may be filled with a pressurized fluid (i.e., gas, liquid) to provide cushioning and stability for the foot during use of the footwear 10. In some implementations, compressibility of a first portion of the plurality of segments 218*a*-218*q* of the chambers 212, 214 under an applied load provides a responsive-type cushioning, while a second portion of the segments 218*a*-218*q* of the chambers 212, 214 may be configured to provide a soft-type cushioning under an applied load. Accordingly, the segments 218*a*-218*q* of the bladder 202 may cooperate to provide gradient cushioning to the article of footwear 10 that changes as the applied load changes (i.e., the greater the load, the more the segments 218*a*-218*q* are compressed and, thus, the more responsive the footwear 10 performs).

In other implementations, one or more cushioning materials, such as polymer foam and/or particulate matter (neither shown), are enclosed by one or more of the segments 218*a*-218*q* in place of, or in addition to, the pressurized fluid to provide cushioning for the foot. In these implementations, the cushioning materials may provide one or more of the segments 218*a*-218*q* with cushioning properties different from the segments 218*a*-218*q* filled with the pressurized fluid. For example, the cushioning materials may be more or less responsive or provide greater impact absorption than the pressurized fluid.

In some implementations, an overmold portion extends over a portion of the bladder 202 to provide increased durability and resiliency for the chambers 212, 214 when under applied loads. The overmold portion may extend over the forefoot region 12, the mid-foot region 14, and/or the heel region 16 by attaching to the lower layer 206 to provide increased durability and resiliency for the bladder 202 where the separation distance between the lower layer 206 and the upper layer 204 is greater, or to provide increased thickness in specific areas of the bladder 202, such as the heel region 16. In some examples, the overmold portion is bonded to the lower layer 206 and includes at least one of a different thickness, a different hardness, and a different material than the lower layer 206. The overmold portion may limited to areas of the lower layer 206 that partially define the chambers 212, 214 residing in the forefoot, mid-foot, and heel regions 12, 14, 16 and, therefore, the overmold portion may be absent from the flange 208 and web area 210. Accordingly, the overmold portion may partially define a plurality of the segments 218*a*-218*q*.

The outsole 300 attaches to and conforms in shape with the midsole 200. The outsole 300 may include a plurality of contact pads 302 for defining the ground-engaging surface 304 of the article of footwear 10. In some examples, the contact pads 302 extend from the lower layer 206 of the bladder 202 in a direction away from the upper 100 to provide increased traction with the ground surface. The contact pads 302 may also cause the bottom surface of the foot to reside higher above the ground surface.

In some examples, the outsole 300 includes the ground-engaging surface 304 and an opposite inner surface 306 that attaches to regions of the lower layer 206 that define the segments 218*a*-218*q*. Accordingly, the outsole 300 may include a plurality of segments each defining a shape that conforms to the shape of a respective segments 218*a*-218*q*, whereby the outsole 300 is absent in regions between the segments 218*a*-218*q* to thereby expose the flange 208 and the web area 210 of the bladder 202. The outsole 300 generally provides abrasion-resistance and traction with the ground surface and may be formed from one or more materials that impart durability and wear-resistance, as well as enhance traction with the ground surface. For example, rubber may form at least a portion of the outsole 300.

In the illustrated example, the outsole 300 is formed as the overmold portion, as described above. Accordingly, the outsole 300 may be formed integrally with the lower layer 206 of the bladder 202 using an overmolding process. In other examples the outsole 300 may be formed separately from the lower layer 206 of the bladder 202 and may be adhesively bonded to the lower layer 206.

Figure 8:
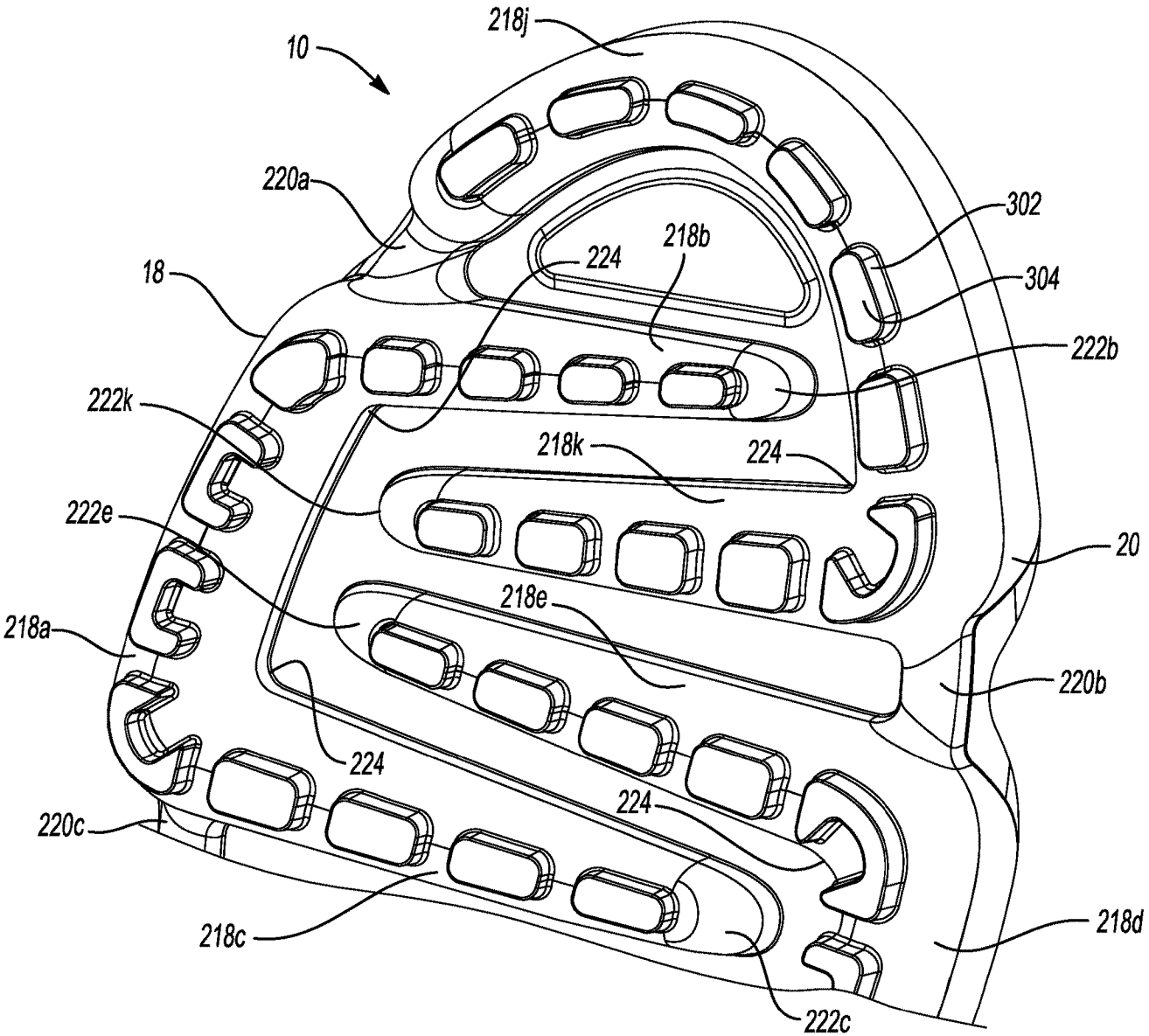
FIG. 8 is a perspective view of a first chamber of a bladder having an outsole attached thereto.
Figure 9:
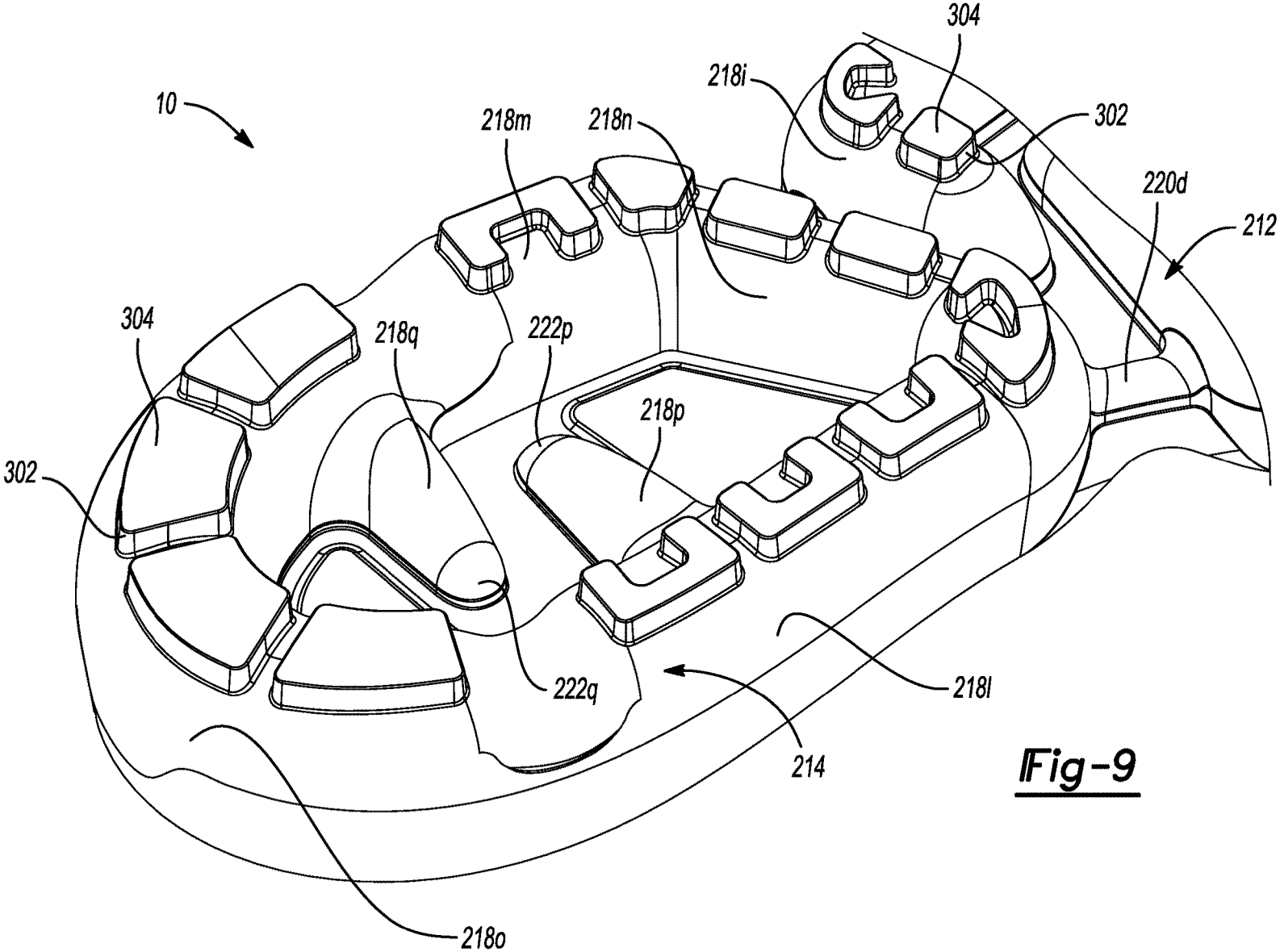
FIG. 9 is a perspective view of a second chamber of a bladder having an outsole attached thereto.

With reference to FIGS. 3, 8, and 9, the geometry and configuration of bladder 202 is shown with reference to bottom perspective views of the footwear 10. As described above, the bladder 202 includes a first chamber 212 and a second chamber 214 having a plurality of segments 218*a*-218*q* and conduits 220*a*-220*d* defining a fluid network. At least one of the segments 218*a*-218*q* may have a different length than the other segments 218*a*-218*q*. As described above, the segments 218*a*-218*q* are formed in areas of the midsole 200 where the upper layer 204 and the lower layer 206 are separated and spaced apart from one another to define respective voids for enclosing the pressurized fluid or cushioning material. As such, the flange 208 and the web area 210 correspond to areas of the bladder 202 where the upper layer 204 and the lower layer 206 are joined and bonded, and cooperate to bound and define a perimeter of each segment 218*a*-218*q* to thereby seal the pressurized fluid therein. Accordingly, the segments 218*a*-218*q* may be disposed within corresponding ones of the regions 12, 14, 16 of the midsole 200 and may be spaced apart from one another by the web area 210. In other words, the one or more segments 218*a*-218*q* may cooperate to bound corresponding regions of the web area 210.

In some implementations, at least two of the segments 218*a*-218*q* extend along the lateral side 18 of the midsole 200 while at least two other segments 218*a*-218*q* extend along the medial side 20 of the midsole 200. Moreover, some of the segments 218*a*-218*q* extend between the lateral side 18 of the midsole 200 and the medial side 20 of the midsole 200. For instance, at least one segment 218*a*-218*q* may extend from one of the lateral side 18 and the medial side 20 to the other one of the lateral side 18 and the medial side 20. Additionally or alternatively, at least one of the segments 218*a*-218*q* extends from one of the lateral side 18 and the medial side 20 to a distal end 222 that terminates at a location between the medial side 20 and the lateral side 18. Here, the distal end(s) 222 may taper in a direction toward the upper 100, (i.e., the lower layer 206 tapers toward the upper layer 204 of the bladder 202 such that the thickness of the segment 218*a*-218*q* decreases along a direction towards the distal end 222).

In some implementations, the segments 218*a*-218*q* are in fluid communication with one another, either directly or via conduits 220, to form a unitary pressure system for the bladder 202. The unitary pressure system directs the fluid through the segments 218*a*-218*q* when under an applied load as the segments 218*a*-218*q* compress or expand to provide cushioning, as well as stability and support, by attenuating ground-reaction forces especially during forward running movements of the footwear 10. Optionally, one or more of the segments 218*a*-218*q* may be fluidly isolated from the other segments 218*a*-218*q* so that at least one of the segments 218*a*-218*q* can be pressurized differently.

In some configurations, at least two adjacent segments 218*a*-218*q* are connected to one another at a bend 224 or turn, whereby each of the segments connected by the corresponding bend 224 extend in different directions from one another. Each bend 224 is associated with an internal radius extending toward the periphery of the midsole 200. In some examples, the radius of each bend 224 is at least 3 mm. Moreover, each bend 224 is disposed proximate to the periphery of the midsole 200 on an opposite side of the respective segment 218*a*-218*q* than the flange 208. By positioning the bends 224 on opposite sides of the segments 218*a*-218*q* than the flange 208, collapsing by the segments 218*a*-218*q* is restricted during directional shifts between loads applied to the midsole 200.

Referring to FIGS. 3 and 8, in some examples, the first chamber 212 includes a plurality of segments 218*a*-218*k* and conduits 220*a*-220*c* extending from the forefoot region 12 into the mid-foot region 14. A first segment 218*a* extends along the lateral side 18 in the forefoot region 12. A second segment 218*b* extends towards the medial side 20 from a first end of the first segment 218*a* and a third segment 218*c* extends towards the medial side 20 from a second end of the first segment 218*a*. The second segment 218*b* and the third segment 218*c* each terminate at distal ends 222*b*, 222*c* disposed between the lateral side 18 and the medial side 20. The second segment 218*b* and the third segment 218*c* diverge from each other in a direction from the lateral side 18 to the medial side 20.

Figure 10:
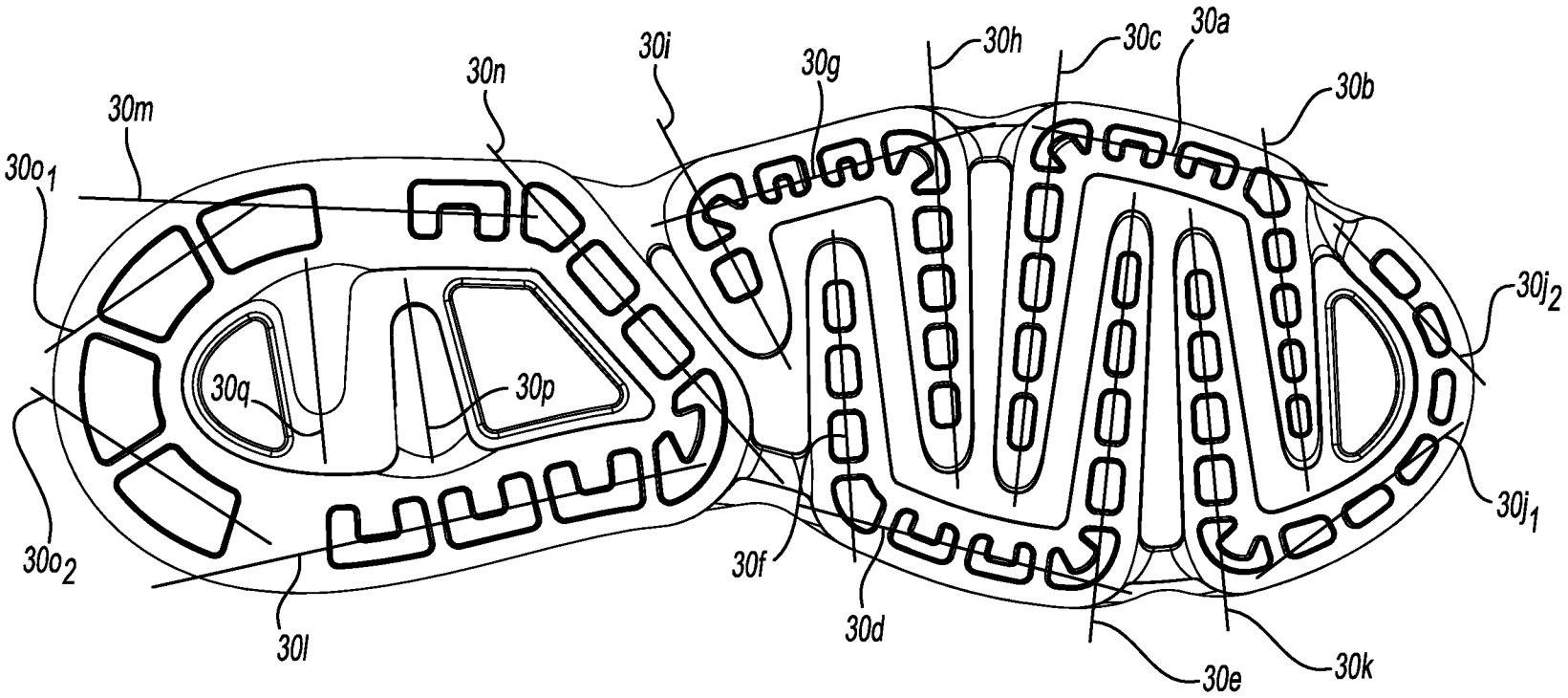
FIG. 10 is a bottom perspective view of the article of footwear of FIG. 1, showing cushioning support vectors defined by a bladder of the sole structure.

A fourth segment 218*d* extends along the medial side 20 of the midsole 200 in the forefoot region 12. A fifth segment 218*e* extends towards the lateral side 18 from a first end of the fourth segment 218*d*, and a sixth segment 218*f* extends towards the lateral side 18 from an opposing second end of the fourth segment 218*d*. Each of the fifth segment 218*e* and the sixth segment 218*f* terminate at distal ends 222*e*, 222*f* disposed between the lateral side 18 and the medial side 20. The fifth segment 218*e* extends between the second segment 218*b* and the third segment 218*c*, while the third segment 218*c* extends between the fifth segment 218*e* and the sixth segment 218*f*. The fifth segment 218*e* diverges from the sixth segment 218*f* in a direction from the medial side 20 to the lateral side 18. Further, the fifth segment 218*e* is adjacent and extends substantially parallel to the third segment 218*c*, as shown in FIG. 10.

The first chamber 212 further includes a seventh segment 218*g* extending along the lateral side 18 from the forefoot region 12 into the mid-foot region 14. An eighth segment 218*h* extends towards the medial side 20 from a first end of the seventh segment 218*g* and a ninth segment 218*i* extends towards the medial side 20 from a second end of the seventh segment 218*g*. The eighth segment 218*h* and the ninth segment 218*i* each terminate at respective distal ends 222*h*, 222*i* between the lateral side 18 and the medial side 20. The terminal end 222*h* of the eighth segment 218*h* extends between the third segment 218*c* and the sixth segment 218*f*, and the terminal end 222*i* of the ninth segment 218*i* extends between the sixth segment 218*f* and the second chamber 214. Accordingly, the sixth segment 218*f* is disposed between the eighth segment 218*h* and the ninth segment 218*i*.

Referring still to FIG. 3, a tenth segment 218*j* extends around a toe portion of the forefoot region 12, from a first end disposed at the lateral side 18 of the midsole 200 to a second end disposed at the medial side 20 of the midsole 200. An eleventh segment 218*k* extends from the second end of the tenth segment 218*j* towards the lateral side 18, and terminates at a distal end 222*k* between the medial side 20 and the lateral side 18. The distal end 222*k* of the eleventh segment 218*k* extends between the second segment 218*b* and the fifth segment 218*e*.

In some examples, the segments 218*b*, 218*c*, 218*e*, 218*f*, 218*h*, 218*i*, 218*k* each extend generally along a direction from the lateral side 18 to the medial side 20. As shown in FIG. 10, the third segment 218*c* and the fifth segment 218*e* extend in parallel along a first direction transverse to the longitudinal axis L, while the second segment 218*b*, the sixth segment 218*f*, the eighth segment 218*h*, and the eleventh segment 218*k* extend in parallel along a second direction transverse to the longitudinal axis L. Accordingly, the segments 218*b*, 218*c*, 218*e*, 218*f*, 218*h*, 218*i*, 218*k* are configured to compress in succession as the outsole 300 rolls for engagement with the ground surface while the footwear 10 is performing a running movement to provide cushioning for the foot. The web area 210 may separate the segments 218*b*, 218*c*, 218*e*, 218*f*, 218*h*, 218*i*, 218*k* from one another such that the web area 210 defines a flexion zone extending from the forefoot region 12 through the mid-foot region 14. The transverse arrangement of the segments 218*b*, 218*c*, 218*e*, 218*f*, 218*h*, 218*i*, 218*k* with respect to the longitudinal axis L, as well as the web area 210 separating the segments 218*b*, 218*c*, 218*e*, 218*f*, 218*h*, 218*i*, 218*k* allow the segments 218*b*, 218*c*, 218*e*, 218*f*, 218*h*, 218*i*, 218*k* to compress under an applied load to provide cushioning for the forefoot by attenuating ground-reaction forces during running movements, while simultaneously dampening oscillation by the foot while the segments 218*b*, 218*c*, 218*e*, 218*f*, 218*h*, 218*i*, 218*k* are under compression.

As shown in FIGS. 3 and 9, the second chamber 214 includes a twelfth segment 218*l* extending along the medial side 20 and a thirteenth segment 218*m* extending along the lateral side 18 from the mid-foot region 14. As shown, the twelfth segment 218*l* extends farther into the mid-foot region 14 than the thirteenth segment 218*m*, which may be disposed entirely within the heel region 16. Accordingly, a length of the twelfth segment 218*l* may be longer than a length of the thirteenth segment 218*m*. The second chamber 214 further includes a fourteenth segment 218*n* extending from the twelfth segment 218*l* in the mid-foot region 14 to the thirteenth segment 218*m* in the heel region 16. Accordingly, the fourteenth segment 218*m* extends from the medial side 20 to the lateral side 18 at an oblique angle with respect to the longitudinal axis L of the midsole 200. A fifteenth segment 218*o* of the second chamber 214 extends around the heel region 16 from the twelfth segment 218*l* on the medial side 20 to the thirteenth segment 218*m* on the lateral side 18. The fifteenth segment 218*o* may be fluidly coupled to each of the twelfth segment 218*l* and the thirteenth segment 218*k*.

The second chamber 214 further includes a pair of anchor segments 218*p*, 218*q* extending transversely to the longitudinal axis L. For example, a first anchor segment 218*p* extends from the twelfth segment 218*l* along the medial side 20 towards the lateral side 18, and terminates at a distal end 222*p* between the twelfth segment 218*l* and the thirteenth segment 218*m*. Similarly, a second anchor segment 218*q* extends from the thirteenth segment 218*m* along the lateral side 18 towards the medial side 20, and terminates at a distal end 222*q* between the thirteenth segment 218*m* and the twelfth segment 218*l*. The second anchor segment 218*q* and the first anchor segment 218*p* extend along substantially parallel axes 30*p*, 30*q*, as shown in FIG. 10.

As provided above, each of the segments 218*l*-218*o* of the second chamber 214 may be filled with a pressurized fluid to impart desirable properties of cushioning and responsiveness. Additionally or alternatively, the one or more of the segments 218*a*-218*q* may include a cushioning material to provide different cushioning characteristics from the pressurized fluid. For example, the tenth segment 218*o* may include a polymer foam cushioning material to increase absorption of an initial impact of the footwear 10 with the ground surface.

As shown in FIGS. 3, 8, and 9, the distal ends 222 include a compound taper, wherein both the thickness T and a width of the segments 218*b*, 218*c*, 218*e*, 218*f*, 218*h*, 218*i*, 218*k*, 218*p*, 218*q* decrease along a direction towards the distal end 222. The tapered distal ends 222 operate as an anchor point for the respective segments 218*b*, 218*c*, 218*e*, 218*f*, 218*h*, 218*i*, 218*k*, 218*p*, 218*q* as well as an anchor point for the bladder 202 as a whole, for retaining the shape thereof when loads such as shear forces are applied thereto.

Referring to FIGS. 3, 8, and 9, the first chamber 212 includes a first conduit 220*a* fluidly coupling the first end of the tenth segment 218*j* to the first end of the first segment 218*a* along the lateral side 18. A second conduit 220*b* fluidly couples the second end of the tenth segment 218*j* to the first end of the fourth segment 218*d* along the medial side 20. Likewise, the second end of the first segment 218*a* is fluidly coupled to the first end of the seventh segment 218*g* by a third conduit 220*c* along the lateral side 18. Accordingly, all of the segments 218*a*-218*k* of the first chamber 212 are in fluid communication with each other, either directly or indirectly. The fourth conduit 220*d* fluidly couples the first end of the twelfth segment 218*l* to the second end of the fourth segment 218*d* of the first chamber 212, thereby fluidly coupling the first chamber 212 and the second chamber 214 along the medial side 20. Conduits 220 may be provided in alternative or additional arrangements to the conduits 220*a*-220*c*. For example, conduits may be included in areas of the bladder 202 between the lateral side 18 and the medial side 20.

FIG. 4 provides a cross-sectional view taken along line 4-4 of FIG. 3 showing the midsole 200 in the forefoot region 12 with the insole 110, the strobel 104 of the upper 100, and the upper layer 204 of the bladder 202 arranged in the layered configuration as described above with reference to FIGS. 1 and 2. As provided above, the peripheral edges of the lower layer 206 may extend upward toward the upper 100 and join with the peripheral edges of the upper layer 204 to form the flange 208 along the medial side 20 and the lateral side 18. The lower layer 206 of the bladder 202 may also extend toward the upper 100 and join with the upper layer 204 to form a region of the web area 210 that extends between and separates the segments 218*c*, 218*d*. For instance, the segment 218*d* extending along the medial side 20 of the midsole 200 is bounded by the web area 210 and the flange 208 formed at the medial side 20, while the segment 218*c* extending from the segment 218*a* at the lateral side 18 toward the medial side 20 is bounded by the web area 210 and the flange 208 formed at the lateral side 18. The distal end 222*c* of the segment 218*c* tapers in the direction toward the upper 100 and terminates at the web area 210 formed at the location between the lateral side 18 and the medial side 20.

The outsole 300 attaches to and conforms in shape with each of the segments 218*a*, 218*c*, 218*d*. In some examples, the contact pad 302 extends from the outsole 300 in a direction away from the upper 100 and along respective lengths of the segments 218*a*, 218*c*, 218*d* to provide increased traction with the ground surface.

FIG. 5 provides a cross-sectional view taken along line 5-5 of FIG. 3 showing the midsole 200 in the forefoot region 12 with the insole 110, the strobel 104 of the upper 100, and the upper layer 204 of the bladder 202 arranged in the layered configuration as described above with reference to FIGS. 1 and 2. The peripheral edges of the lower layer 206 may extend upward toward the upper 100 and join with the peripheral edges of the upper layer 204 to form the flange 208 along the medial side 20 and the lateral side 18. The lower layer 206 of the bladder 202 may also extend toward the upper 100 and join with the upper layer 204 to form a region of the web area 210 that extends between and separates the segments 218*f*, 218*g*. For instance, the segment 218*g* extending along the lateral side 18 of the midsole 200 is bounded by the web area 210 and the flange 208 formed at the lateral side 18, while the segment 218*f* extending from the segment 218*d* at the medial side 20 toward the lateral side 18 is bounded by the web area 210 and the flange 208 formed at the medial side 20. The distal end 222*f* of the segment 218*f* tapers in the direction toward the upper 100 and terminates at the web area 210 formed at the location between the lateral side 18 and the medial side 20.

The outsole 300 attaches to and conforms in shape with each of the segments 218*d*, 218*f*, 218*g*. In some examples, the contact pad 302 extends from the outsole 300 in a direction away from the upper 100 and along respective lengths of the segments 218*d*, 218*f*, 218*g* to provide increased traction with the ground surface.

FIG. 6 provides a cross-sectional view taken along line 6-6 of FIG. 3 showing the midsole 200 in the heel region 16 with the insole 110, the strobel 104, and the upper layer 204 of the bladder 202 arranged in the layered configuration as described above with reference to FIGS. 1 and 2. The peripheral edges of the lower layer 206 may extend upward toward the upper 100 and join with the peripheral edges of the upper layer 204 to form the flange 208 along the medial side 20 and the lateral side 18. Relative to the view of FIG. 6, the lower layer 206 protrudes away from the upper layer 204 in a direction away from the upper 100 to define the twelfth segment 218*l* along the medial side 20, the thirteenth segment 218*m* along the lateral side 18, and the first anchor segment 218*p* of the second chamber 214.

FIG. 7 provides a cross-sectional view taken along line 7-7 of FIG. 3 showing the midsole 200 and outsole 300 extending through the heel region 16, the mid-foot region 14, and the forefoot region 12. As described above with reference to the footwear 10 of FIGS. 1 and 2, the outsole 300 attaches to portions of the lower layer 206 in regions where the chambers 212,214 protrude away from the upper 100 to provide increased durability and resiliency for the bladder 202 in the heel region 16, the mid-foot region 14, and the forefoot region 12. Moreover, the segments 218*b*, 218*c*, 218*e*, 218*f*, 218*h*, 218*i*, 218*k*, 218*p*, 218*q* extend between the lateral side 18 and the medial side 20. The web area 210 may separate and extend between the segments 218*b*, 218*c*, 218*e*, 218*f*, 218*h*, 218*i*, 218*k*, 218*p*, 218*q* relative to the view of FIG. 7. In some examples, the segments 218*a*-218*k* extend into the forefoot region 12 and are associated with a smaller thickness than segments 218*l*-218*o* in the heel region 16 and/or mid-foot region 14.

FIG. 8 provides a bottom perspective view of the segments 218*a*-218*e*, 218*j*, 218*k* fluidly connected to one another and disposed within the forefoot region 12 of the midsole 200. In some examples, the segments 218*b*, 218*c*, 218*e*, 218*k* extend between the lateral side 18 and the medial side 20 to the distal ends 222*b*, 222*c*, 222*e*, 222*k* that terminate at a location between the lateral side 18 and the medial side 20. The distal ends 222*b*, 222*c*, 222*e*, 222*k* may taper in a direction toward the upper 100. The tapering by the distal end 222*b*, 222*c*, 222*e*, 222*k* of the segments 218*b*, 218*c*, 218*e*, 218*k* may function as an anchor point for the segments 218*b*, 218*c*, 218*e*, 218*k* when under an applied load.

FIG. 9 provides a bottom perspective view of the segments 218*l*-218*q* fluidly connected to one another and disposed within the heel region 16 of the midsole 200. In some examples, the segments 218*p*, 218*q* extend between the lateral side 18 and the medial side 20 to the distal ends 222*p*, 222*q* that terminate at a location between the lateral side 18 and the medial side 20. The distal ends 222*p*, 222*q* may taper in a direction toward the upper 100. The tapering by the distal ends 222*p*, 222*q* of the segments 218*p*, 218*q* may function as an anchor point for the segments 218*l*, 218*m* when under an applied load.

FIG. 10 provides a bottom perspective view of the article of footwear 10 of FIG. 1 showing a plurality of cushioning support vectors 30*a*-30*q* defined by the segments 218*a*-218*q*. More particularly, a longitudinal axis of each of the segments 218*a*-218*q* define respective ones of the cushioning support vectors 30*a*-30*q*. Applied loads associated with directions parallel to a cushioning support vector cause the one or more corresponding segments to substantially retain their shape without collapsing to provide support and stability for the foot in those regions. On the other hand, applied loads associated with directions transverse to a cushioning support vector cause the one or more corresponding segments to compress and collapse to provide cushioning for the foot in those regions by attenuating the ground-reaction force associated with the applied load. Longitudinal cushioning support vectors 30*a*, 30*d*, 30*g*, 30*m*, 30*l* may extend in a direction along the longitudinal axis L of the midsole 200 while lateral cushioning support vectors 30*b*, 30*c*, 30*e*, 30*f*, 30*h*, 30*i* extend transversely to the longitudinal axis L of the midsole 200. For instance, the lateral cushioning support vectors 30*b*, 30*c*, 30*e*, 30*f*, 30*h*, 30*i* may define angles within 15 degrees) (15°) from perpendicular relative to the longitudinal axis L of the midsole 200. The tenth, fourteenth, and fifteenth segments 218*j*, 218*n*, 218*o* each define compound cushioning support vectors $30j_{1,2}$, 30*n*, $30o_{1,2}$, whereby the angled and/or curved segments 218*j*, 218*n*, 218*o* provide a degree of responsive support along both the longitudinal and lateral directions of the midsole 200.

During forward movements, such as walking or running movements, loads applied to the midsole 200 are associated with a direction parallel to the longitudinal cushioning support vectors 30*a*, 30*d*, 30*g*, 30*m*, 30*l* to cause the respective segments 218*a*, 218*d*, 218*g*, 218*m*, 218*l* to be under shear force, thereby causing the respective segments 218*a*, 218*d*, 218*g*, 218*m*, 218*l* to retain their shape (e.g., not compress) and provide support and stability as the outsole rolls for engagement with the ground surface through the heel region 16 and the mid-foot region 14. The web area 210 extending between the segments 218*a*, 218*d*, 218*g*, 218*m*, 218*l* reduces torsional forces from acting upon the segments 218*a*, 218*d*, 218*g*, 218*m*, 218*l* when under applied load to thereby dampen oscillations by the foot while providing gradient responsive-type cushioning.

During lateral movements, such as shifting or cutting movements, loads applied to the midsole 200 are associated with a direction transverse and generally perpendicular to longitudinal cushioning support vectors 30*a*, 30*d*, 30*g*, 30*m*, 30*l*. Thus, the segments 218*a*, 218*g*, 218*m* defining one of the vectors 30*a*, 30*g*, 30*m* will compress to provide cushioning for the lateral side of the foot when the applied load is in a direction toward the lateral side 18 of the midsole 200, while the segments 218*d*, 218*l* defining the other vectors 30*d*, 30*l* will compress to provide cushioning for the medial side of the foot when the applied load is in a direction toward the medial side 20 of the midsole 200.

In some implementations, a series of lateral cushioning support vectors 30*b*, 30*c*, 30*e*, 30*f*, 30*h*, 30*i* are disposed within the mid-foot 14 and forefoot region 12 and extend in a direction transverse to the longitudinal axis L of the midsole 200. During forward movements, such as walking or running movements, loads applied to the midsole 200 are associated with a direction transverse to the lateral cushioning support vectors 30*b*, 30*c*, 30*e*, 30*f*, 30*h*, 30*i*. Thus, the respective segments 218*b*, 218*c*, 218*e*, 218*f*, 218*h*, 218*i* defining respective ones of the vectors 30*b*, 30*c*, 30*e*, 30*f*, 30*h*, 30*i* successively compress and collapse to provide cushioning for the metatarsal region of the foot through push off from the ground-surface. The direction of the vectors 30*b*, 30*c*, 30*e*, 30*f*, 30*h*, 30*i* relative to the direction of the applied load as well as a length of the respective segments 218*b*, 218*c*, 218*e*, 218*f*, 218*h*, 218*i* dictates how the segments will compress for attenuating the ground-reaction force.

During lateral movements, such as shifting or cutting movements, loads applied to the midsole 200 are associated with a direction generally parallel or only slightly transverse to the lateral cushioning support vectors 30*b*, 30*c*, 30*e*, 30*f*, 30*h*, 30*i* to cause the respective segments 218*b*, 218*c*, 218*e*, 218*f*, 218*h*, 218*i* to be under shear force, thereby causing the respective segments 218*b*, 218*c*, 218*e*, 218*f*, 218*h*, 218*i* to retain the their shape (e.g., not compress or slightly compress) and provide support and stability for the metatarsal region of the foot responsive to the footwear 10 performing a lateral movement. With reference to FIG. 3, the distal ends 222 of the segments 218*b*, 218*c*, 218*e*, 218*f*, 218*h*, 218*i*, 218*p*, 218*q* may each taper in the direction toward the upper 100 and serve as anchor points for the bladder 202 as a whole.

As provided above, the midsole 200 further defines a series of compound cushioning support vectors $30j_{1,2}$, 30*n*, $30o_{1,2}$, which are each configured to provide a degree of both longitudinal cushioning and responsiveness and lateral cushioning and responsiveness, thereby supplementing the lateral cushioning support vectors 30*b*, 30*c*, 30*e*, 30*f*, 30*h*, 30*i* and the longitudinal cushioning support vectors 30*a*, 30*d*, 30*g*, 30*m*, 30*l*.

The segments 218*a*-218*q* associated with the chambers 212, 214 may cooperate to enhance the functionality and cushioning characteristics that a conventional midsole provides, while simultaneously providing increased stability and support for the foot by dampening oscillations of the foot that occur in response to a ground-reaction force during use of the footwear 10. For instance, an applied load to the midsole 200 during forward movements, such as walking or running movements, may cause some of the segments 218*a*-218*q* to compress to provide cushioning for the foot by attenuating the ground-reaction force, while other segments 218*a*-218*q* may retain their shape to impart stability and support characteristics that dampen foot oscillations relative to the footwear 10 responsive to the initial impact of the ground-reaction force.

Moreover, one or more of the segments 218*a*-218*q* may interact with the web area 210 within different regions 12, 14, 16 of the midsole 200 to provide isolated areas of responsive-type cushioning. For example, the segments 218*l*-218*o* within the heel region 16 may bound a respective portion of the web area 210 to provide responsive-type cushioning in the heel region 16 by causing the segments 218*l*-218*o* around the perimeter of the heel region 16 to absorb the initial impact of a ground-reaction force by creating a trampoline effect as the segments 218*l*-218*o* compress in succession, and thereby provide a gradient responsive-type cushioning in the heel region 16.

Additionally, the geometry and positioning of the segments 218*a*-218*q* along the midsole 200 may enhance traction between the outsole 300 and the ground surface during forward movements as the outsole 300 rolls for engagement with the ground surface from the heel region 16 to the forefoot region 12, as well as during lateral movements as the outsole 300 rolls for engagement with the ground surface from one of the lateral side 18 and the medial side 20 to the other one of the lateral side 18 and the medial side 20.

The following Clauses provide an exemplary configuration for an article of footwear described above.

Clause 1: A sole structure for an article of footwear having an upper, the sole structure comprising a heel region, a forefoot region, a mid-foot region disposed between the heel region and the forefoot region, and a fluid-filled chamber including a first barrier layer cooperating with a second barrier layer to define a first segment extending along a medial side of the sole structure from the mid-foot region though the heel region, a second segment extending along a lateral side of the sole structure within the heel region, a third segment extending from one of the first segment and the second segment and terminating at a distal end intermediate the first segment and the second segment, and a web area disposed between and connecting the first segment and the second segment and a web area disposed between and connecting the first segment, the second segment, and the third segment, the first barrier layer being attached to the second barrier layer within the web area.

Clause 2: The sole structure of Clause 1, wherein the third segment tapers continuously in a direction towards the upper from the one of the first segment and the second segment to the distal end of the third segment.

Clause 3: The sole structure of Clause 1, wherein the chamber includes a fourth segment extending from the first segment in the mid-foot region to the second segment within the heel region.

Clause 4: The sole structure of Clause 3, wherein the chamber includes a fifth segment extending around the heel region and fluidly coupled to the first segment and the second segment.

Clause 5: The sole structure of Clause 4, wherein the first segment, the second segment, the fourth segment, and the fifth segment include a contact pad.

Clause 6: The sole structure of Clause 5, wherein the contact pad defines a ground-engaging surface of the sole structure.

Clause 7: The sole structure of Clause 6, wherein the web area is recessed from the ground-engaging surface.

Clause 8: The sole structure of Clause 1, wherein the chamber includes a fourth segment extending from the other of the first segment and the second segment and terminating at a distal end between the first segment and the second segment.

Clause 9: The sole structure of Clause 8, wherein the fourth segment tapers continuously in a direction towards the upper from the other of the first segment and the second segment to the distal end of the fourth segment.

Clause 10: The sole structure of Clause 9, wherein the third segment extends substantially parallel to the fourth segment.

Clause 11: The sole structure of Clause 9, wherein the third segment and the fourth segment extend substantially perpendicular to a longitudinal axis of the sole structure.

Clause 12: A sole structure for an article of footwear having an upper, the sole structure comprising a heel region, a forefoot region, a mid-foot region disposed between the heel region and the forefoot region, and a fluid-filled chamber including a first barrier layer cooperating with a second barrier layer to define a first segment extending along one of a medial side of the sole structure and a lateral side of the sole structure with the forefoot region, a second segment extending from a first end of the first segment towards the other of the medial side and the lateral side, and a third segment extending from a second end of the first segment towards the other of the medial side and the lateral side and being divergent from the second segment.

Clause 13: The sole structure of Clause 12, wherein the chamber includes a fourth segment extending along the other of the medial side and the lateral side, a fifth segment extending from a first end of the fourth segment towards the one of the medial side and the lateral side, and a sixth segment extending from a second end of the fourth segment towards the one of the medial side and the lateral side, the fifth segment disposed between the second segment and the third segment.

Clause 14: The sole structure of Clause 13, wherein the chamber includes a seventh segment extending along the one of the medial side and the lateral side, an eighth segment extending from a first end of the seventh segment towards the other of the medial side and the lateral side, and a ninth segment extending from a second end of the seventh segment towards the other of the medial side and the lateral side.

Clause 15: The sole structure of Clause 14, wherein the third segment and the eighth segment are disposed between the fifth segment and the sixth segment.

Clause 16: The sole structure of Clause 15, wherein the sixth segment is disposed between the eighth segment and the ninth segment.

Clause 17: The sole structure of Clause 15, wherein the chamber includes a tenth segment extending around the forefoot region from a first end on the one of the medial side and the lateral side to a second end on the other of the medial side and the lateral side.

Clause 18: The sole structure of Clause 17, wherein the chamber includes an eleventh segment extending from the second end of the tenth segment towards the one of the medial side and the lateral side.

Clause 19: The sole structure of Clause 18, wherein the fifth segment and the eleventh segment are disposed between the second segment and the third segment.

Clause 20: The sole structure of Clause 18, wherein the second segment, the sixth segment, the seventh segment, and the eleventh segment are substantially parallel.

Clause 21: The sole structure of Clause 18, wherein the third segment is substantially parallel to the fifth segment.

Clause 22: The sole structure of Clause 18, wherein the second, third, fifth, sixth, eighth, ninth, and eleventh segments each terminate at a distal end between the medial side and the lateral side.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear having an upper, the sole structure comprising:

a heel region;

a forefoot region;

a mid-foot region disposed between the heel region and the forefoot region; and a fluid-filled chamber including a first barrier layer cooperating with a second barrier layer to define a first segment extending along a medial side of the sole structure from the mid-foot region through the heel region, a second segment extending along a lateral side of the sole structure within the heel region, a third segment directly fluidly coupled to and extending from one of the first segment and the second segment and terminating at a distal end intermediate the first segment and the second segment, a fourth segment extending continuously from a forward-most point of the first segment and a forward-most point of the second segment and directly fluidly connecting the first segment and the second segment, and a web area disposed between and connecting the first segment, the second segment, and the third segment, the third segment including a width tapering continuously from the one of the first segment and the second segment to the distal end of the third segment and in a direction toward the distal end of the third segment, the first barrier layer being attached to the second barrier layer within the web area.

2. The sole structure of claim 1, wherein a thickness of the third segment tapers continuously along at least a portion of a length of the third segment in a direction towards the upper from the one of the first segment and the second segment to the distal end of the third segment.

3. The sole structure of claim 1, wherein the fluid-filled chamber includes a fifth segment extending around the heel region and fluidly coupled to the first segment and the second segment.

4. The sole structure of claim 3, wherein at least one of the first segment, the second segment, the fourth segment, and the fifth segment includes a contact pad.

5. The sole structure of claim 4, wherein the contact pad defines a ground-engaging surface of the sole structure.

6. The sole structure of claim 5, wherein the web area is recessed from the ground-engaging surface.

7. The sole structure of claim 1, wherein the fluid-filled chamber includes a fifth segment directly fluidly coupled to and extending from the other of the first segment and the second segment and terminating at a distal end between the first segment and the second segment.

8. The sole structure of claim 7, wherein a thickness of the fifth segment tapers continuously along at least a portion of a length of the fifth segment in a direction towards the upper from the other of the first segment and the second segment to the distal end of the fifth segment.

9. The sole structure of claim 8, wherein the third segment extends parallel to the fifth segment.

10. The sole structure of claim 8, wherein the third segment and the fifth segment extend perpendicular to a longitudinal axis of the sole structure.

11. A sole structure for an article of footwear having an upper, the sole structure comprising:

a heel region;

a forefoot region;

a mid-foot region disposed between the heel region and the forefoot region; and a fluid-filled chamber including a first barrier layer cooperating with a second barrier layer to define a plurality of segments, the plurality of segments including a first segment extending along one of a medial side of the sole structure and a lateral side of the sole structure within the forefoot region, a second segment extending from a first end of the first segment towards the other of the medial side and the lateral side, a third segment extending from a second end of the first segment towards the other of the medial side and the lateral side in a first direction and being divergent from the second segment in the first direction, a fourth segment extending along the other of the medial side and the lateral side, a fifth segment extending from a first end of the fourth segment towards the one of the medial side and the lateral side and between the second segment and the third segment from a bottom perspective of the sole structure, and a sixth segment extending from a second end of the fourth segment towards the one of the medial side and the lateral side, each of the segments in the plurality of segments defining a substantially tubular cross-sectional shape extending between the first barrier layer and the second barrier layer.

12. The sole structure of claim 11, wherein the fluid-filled chamber includes a seventh segment extending along the one of the medial side and the lateral side, an eighth segment extending from a first end of the seventh segment towards the other of the medial side and the lateral side, and a ninth segment extending from a second end of the seventh segment towards the other of the medial side and the lateral side.

13. The sole structure of claim 12, wherein the third segment and the eighth segment are disposed between the fifth segment and the sixth segment.

14. The sole structure of claim 13, wherein the sixth segment is disposed between the eighth segment and the ninth segment.

15. The sole structure of claim 13, wherein the fluid-filled chamber includes a tenth segment extending around the forefoot region from a first end on the one of the medial side and the lateral side to a second end on the other of the medial side and the lateral side.

16. The sole structure of claim 15, wherein the fluid-filled chamber includes an eleventh segment extending from the second end of the tenth segment towards the one of the medial side and the lateral side.

17. The sole structure of claim 16, wherein the fifth segment and the eleventh segment are disposed between the second segment and the third segment.

18. The sole structure of claim 16, wherein the second segment, the sixth segment, the ninth segment, and the eleventh segment are parallel and/or the third segment is parallel to the fifth segment.

19. The sole structure of claim 16, wherein the second, third, fifth, sixth, eighth, ninth, and eleventh segments each terminate at a distal end between the medial side and the lateral side.

* * * * *